US010902993B2

(12) United States Patent
Rylko et al.

(10) Patent No.: US 10,902,993 B2
(45) Date of Patent: Jan. 26, 2021

(54) INDUCTOR ASSEMBLY COMPRISING AT LEAST ONE INDUCTOR COIL THERMALLY COUPLED TO A METALLIC INDUCTOR HOUSING

(71) Applicant: SMA Solar Technology AG, Niestetal (DE)

(72) Inventors: Marek Rylko, Bielsko-Biala (PL); Mariusz Walczak, Cracow (PL); Milosz Handzel, Cracow (PL); Mariusz Gwadera, Cracow (PL); Jakub Hachlowski, Skawina (PL)

(73) Assignee: SMA Solar Technology AG, Niestetal (DE)

( * ) Notice: Subject to any disclaimer, the term of this patent is extended or adjusted under 35 U.S.C. 154(b) by 1042 days.

(21) Appl. No.: 15/375,264

(22) Filed: Dec. 12, 2016

(65) Prior Publication Data

US 2017/0092416 A1 Mar. 30, 2017

Related U.S. Application Data

(63) Continuation of application No. PCT/EP2015/006331, filed on Jun. 15, 2015.

(30) Foreign Application Priority Data

Jun. 19, 2014 (EP) ..... 14173136

(51) Int. Cl.
*H01F 27/28* (2006.01)
*H01F 27/02* (2006.01)
(Continued)

(52) U.S. Cl.
CPC ..... *H01F 27/2876* (2013.01); *H01F 27/025* (2013.01); *H01F 27/22* (2013.01); *H01F 27/306* (2013.01)

(58) Field of Classification Search
CPC ..... H01F 27/2876; H01F 27/235; H01F 27/2823; H01F 27/02
(Continued)

(56) References Cited

U.S. PATENT DOCUMENTS 2,911,604 A * 11/1959 Krause ..... H01F 27/022 336/90
4,000,483 A 12/1976 Cook et al.
(Continued)

FOREIGN PATENT DOCUMENTS

DE 3522740 A1 6/1985
DE 9406996.4 4/1994
(Continued)

OTHER PUBLICATIONS

International Search Report dated Aug. 28, 2015 PCT/EP/2015/063361.

*Primary Examiner* — Tszfung J Chan
(74) *Attorney, Agent, or Firm* — Eschweiler & Potashnik, LLC

(57) ABSTRACT

An inductor assembly includes at least one inductor coil, a metallic inductor housing at least partially enclosing the inductor coil, and a potting material both contacting the inductor coil and the metallic inductor housing and thermally coupling the inductor coil to the metallic inductor housing. The inductor coil includes a bobbin made of electrically insulating material, and an inductor winding made of an electric conductor wound on the bobbin. The inductor winding further has an outer circumference and two end faces, and an electric insulation covers the outer circumference of the inductor winding. Coil lids made of electrically insulating material at least partially cover the end faces of the inductor winding and adjacent areas of the electric insulation covering the outer circumference of the inductor winding such that a distance of any point of the end
(Continued)

faces of the inductor winding to the metallic housing along any way not passing through the electrically insulating material of the coil lids or the bobbin is at least a required minimum creepage distance.

14 Claims, 11 Drawing Sheets

(51) Int. Cl.
*H01F 27/22* (2006.01)
*H01F 27/30* (2006.01)

(58) Field of Classification Search
USPC ..... 336/61, 90, 92, 96, 98, 196, 197, 198
See application file for complete search history.

(56) References Cited

U.S. PATENT DOCUMENTS

| | | | | |
|---|---|---|---|---|
| 4,914,413 | A | 4/1990 | McGrath | |
| 6,392,519 | B1 * | 5/2002 | Ronning | H01F 27/025 336/61 |
| 6,593,836 | B1 * | 7/2003 | LaFleur | H01F 27/22 336/198 |
| 8,279,035 | B2 | 10/2012 | Yoshikawa et al. | |
| 9,153,372 | B2 | 10/2015 | Ueno et al. | |
| 2002/0047616 | A1 | 4/2002 | Yamaguchi | |
| 2006/0044103 | A1 * | 3/2006 | Roebke | H01F 27/10 336/208 |
| 2007/0273466 | A1 | 11/2007 | Yang et al. | |
| 2008/0079525 | A1 | 4/2008 | Sundaram | |
| 2009/0066290 | A1 * | 3/2009 | Altekruse | H02J 7/0029 320/108 |
| 2012/0194311 | A1 * | 8/2012 | Suzuki | H01F 27/266 336/92 |
| 2012/0299678 | A1 | 11/2012 | Inaba et al. | |
| 2013/0265129 | A1 | 10/2013 | Ansari et al. | |
| 2013/0294129 | A1 * | 11/2013 | Inaba | H02M 3/1582 363/131 |
| 2014/0320256 | A1 | 10/2014 | Inaba | |
| 2015/0179329 | A1 * | 6/2015 | Miyamoto | H02M 1/12 323/214 |
| 2016/0055953 | A1 * | 2/2016 | Hirata | H01F 27/022 336/96 |

FOREIGN PATENT DOCUMENTS

| | | | | |
|---|---|---|---|---|
| DE | 19814897 | A1 | | 4/1998 |
| DE | 102011076227 | A1 | | 5/2011 |
| JP | 6247117 | U | | 3/1987 |
| JP | H11307365 | | | 4/1998 |
| JP | 2000138124 | A | * | 5/2000 |
| JP | 2000138124 | A | | 5/2000 |
| JP | 2001176735 | A | * | 6/2001 |
| JP | 2001176735 | A | | 6/2001 |
| JP | 2004259794 | A | | 9/2004 |
| JP | 2008210976 | A | * | 9/2008 |
| JP | 2008210976 | A | | 9/2008 |
| JP | 2010045110 | A | | 2/2010 |
| JP | 2013239599 | A | | 11/2013 |
| JP | 2013239599 | A | * | 11/2013 |
| JP | 2014103168 | A | | 6/2014 |
| WO | 2005052964 | A1 | | 6/2005 |
| WO | 2011101976 | A1 | | 5/2011 |

* cited by examiner

INDUCTOR ASSEMBLY COMPRISING AT LEAST ONE INDUCTOR COIL THERMALLY COUPLED TO A METALLIC INDUCTOR HOUSING

CROSS REFERENCE TO RELATED APPLICATIONS

This application claims priority to International Patent Application number PCT/EP2015/06331, filed on Jun. 15, 2015, which claims priority to European Patent Application number 14173136.4, filed on Jun. 19, 2014, and is hereby incorporated by reference in its entirety.

TECHNICAL FIELD

The present disclosure relates to an inductor assembly comprising at least one inductor coil, a metallic inductor housing at least partially enclosing the inductor coil, and a potting material both contacting the inductor coil and the inductor housing and thermally coupling the inductor coil to the inductor housing.

BACKGROUND

The electric insulation covering the outer circumference of the inductor winding may be a separate electric insulation, like for example an electrically insulating foil wound around the outer circumference of the inductor winding. The electric insulation covering the outer circumference of the inductor winding, however, may also be provided by an electric insulation wound on the bobbin together with the electric conductor, if this electric insulation of the electric conductor is of a sufficient strength. Often, the electric conductor wound on the bobbin of an inductor coil is provided with a thin layer of an electrically insulating lacquer. Such an electrically insulating lacquer will only be sufficient for providing a sufficient electric insulation of the inductor winding towards each other but not towards the metallic inductor housing. Thus, a separate electric insulation covering the outer circumference of the inductor winding is required.

The metallic housing of the inductor assembly is pot-shaped to receive the potting material. At the open side of the pot-shaped metallic housing, the inductor assembly may end with the potting material at least partially enclosing the inductor coil within the metallic housing, or it may be closed by a metallic closure plate or any other kind of metallic closure.

An inductor assembly as defined at the beginning may, for example, be used as an AC or DC choke, as an AC or DC filter, or as an electric energy storage inductor, for example. In any of these applications, it is required to electrically insulate the inductor winding from the metallic inductor housing. Often, it is also a requirement to electrically insulate the inductor winding from a magnetic core of the inductor assembly on which the bobbin of the at least one inductor coil is arranged. On the other hand, a good thermal coupling of the inductor housing to the inductor coil, and the magnetic core, respectively, is needed to dissipate heat generated both in the inductor coil and the magnetic core by an electric current flowing through the inductor coil. Thus, there are divergent requirements to the potting material, as a potting material providing a good electric insulation normally does not provide for a good thermal coupling. Additionally, potting materials comprising an electrically insulating resin matrix, like for example polyurethane, epoxy or silicone resin, and a filler of thermally conductive particles, like for example ceramic, quartz, AlN or BN particles, to meet both requirements, often display a large viscosity in their fluid state due to the filler. Thus, they are not suited to fill small gaps between the inductor coil and the metallic housing without forming voids. Voids in the potting material, however, reduce the thermal coupling of the inductor coil to the metallic housing and may trigger a breakdown of the electric insulation between the inductor winding and the metallic housing. A breakdown of the electric insulation between the inductor winding and the metallic housing in addition may also be triggered by the filler of thermally conductive particles inside the resin matrix. This is often the case at regions, where a mean distance between the thermally conductive particles is relatively small. Within a typical bulk volume of the potting material at the inside of the metallic housing the distribution of the thermally conductive particles is not ideally homogeneous. Moreover, it varies due to agglomerates, which may be generated during the potting process in particular at small gaps, for instance between the inductor winding and the metallic housing. Within these agglomerates the mean distance between the thermally conductive particles is relatively small and therefore the risk of triggering an electric breakdown is relatively high. Therefore, the thermally conductive filler typically jeopardizes an electric insulation capability of the potting material. Additionally, with small distances between the inductor coil and the metallic housing, it is required to exactly position the inductor coil within the metallic housing so that all gaps between the inductor coil and the metallic housing to be filled with the potting material have a uniform width.

US 2013/0265129 A1 discloses an electromagnetic device including a transformer assembly. The transformer assembly has a core, windings, and a housing disposed around at least a portion of the core and the windings. An enclosure at least partially encloses the transformer assembly. The transformer assembly is mounted to a first portion of the enclosure such that heat is transferred from the transformer assembly to the first portion of the enclosure. A second portion of the enclosure has an extension extending therefrom such that the extension is placed in a thermal contact with the transformer assembly to transfer heat from the transformer assembly to the extension.

DE 10 2011 076 227 A1 discloses an inductive component, like for example a choke, which is used for smoothing the voltage in an electric conductor. The inductive component has an inductor coil comprising at least one inductor winding of an electric wire conductor. The inductor coil is contained in a housing. A thermally conductive pad is arranged between the inductor coil and the housing. The pad may be a thermal pad or it may be made of a phase change material, a material of gel-like consistence or a gap filler material.

WO 2005/052964 A1 discloses a heat conducting bridge for toroidal core inductive resistors. A toroidal core is encircled by at least one winding. A heat conducting bridge is formed by a base element and an element extending from the base element into the center of the toroidal core so that the toroidal core is placed around this element. The base element closes a pot-shaped housing in which the toroidal core is enclosed by a potting material.

DE 35 22 740 A1 discloses a further transformer or choke comprising a toroidal core. Here, a heat conducting element extending into the center of the toroidal core extends from a metallic housing in which the toroidal core and a winding on the toroidal core are enclosed by a granulate material, e.g.

quartz sand. The metallic housing comprises cooling ribs for dissipating heat from the winding and the toroidal core.

DE 198 14 897 A1 discloses an inductive component for high powers in which a toroidal core with a winding is arranged in a pot-shaped housing and embedded in a potting material. From the housing, a heat pipe extends into the center of the toroidal core.

Another inductive component comprising a toroidal core and a winding enclosed by a potting material within a metallic housing is known from DE 94 06 996 U1. Here, an element of the housing extending into the center of the toroidal core comprises ring-shaped ribs increasing the surface of this heat transferring element towards the potting material made of resin.

U.S. Pat. No. 4,000,483 A discloses a transformer comprising a laminated magnetic core, an electrically insulating plastic bobbin on which a primary coil is wound, an electrically insulating plastic bobbin on which a secondary coil is wound, and two interengaging electrically insulating plastic covers which enclose the primary coil and provide additional electric insulation between the primary coil and the laminated magnetic core and between the primary and secondary coil. The plastic components are formed to provide 2 mm of electric insulation between the primary and secondary coils, and between the primary coil and the laminated magnetic core. The plastic components are arranged to provide at least 10 mm of creepage distance between the primary and secondary coils and at least 8 mm between the primary coil and the laminated magnetic core. The insulation provided shall allow for mounting the laminated magnetic core directly on the metal frame of an appliance.

US 2008/0079525 A1 discloses an in-line filament transformer for a vacuum device. The filament transformer comprises a core, a primary winding and a secondary winding wound around the core. The secondary winding is biased at a high voltage, and the primary winding is placed in line with the secondary winding. The primary winding and the secondary winding are incorporated in separate bobbins or in a common bobbin. A creepage distance between the primary winding and the secondary winding is provided by a distance between bobbin sections incorporating the primary and the secondary winding. Further, a shield in a primary section of the bobbin is provided for shielding the primary winding from the secondary winding. This shield may be in the form of a shield winding of thin wires. An outer circumference of the secondary winding incorporated within a secondary bobbin section is enclosed by an insulation. Towards a magnetic core, the insulation may be made of an insulating sheet bent in the form of a "C" or of a cap made of an electrically insulating polymeric material. This sheet or cap is anchored in free bobbin sections on both sides of the secondary bobbin section incorporating the secondary winding.

There still is a need of an inductor assembly in which an inductor coil is effectively thermally coupled to but electrically insulated from an inductor housing and which is nevertheless produced at low cost.

SUMMARY

An inductor assembly according to the present disclosure comprises at least one inductor coil, a metallic inductor housing at least partially enclosing the inductor coil, and a potting material both contacting the inductor coil and the inductor housing and thermally coupling the inductor coil to the inductor housing. The inductor coil includes a bobbin made of electrically insulating material and an inductor winding made of an electric conductor wound on the bobbin. The inductor winding has an outer circumference and two end faces. An electric insulation covers the outer circumference of the inductor winding. Coil lids also made of electrically insulating material at least partially cover the end faces of the inductor winding and adjacent areas of the electric insulation covering the outer circumference of the inductor winding such that a distance of any point of the end faces of the inductor winding to the metallic housing along any way not passing through the electrically insulating material of the coil lids or the bobbin is at least a required minimum creepage distance.

The disclosure is based on the finding that critical points with regard to the electric insulation between the inductor coil and the metallic inductor housing are those points of the end faces of the inductor winding of the inductor coil which are closest to the metallic inductor housing. Even if these end faces are as such covered by flanges of the bobbin on which the inductor winding is wound, and if the inductor winding, at its outer circumference, is covered by the electric insulation, there will be points of the end faces of the inductor winding which are very close to the metallic inductor housing. Independently on the potting material, the present disclosure ensures that no breakdown of the electric insulation between the inductor coil and the metallic inductor housing takes place at these points by providing the coil lids. These coil lids by at least partially covering the end faces of the inductor winding and adjacent areas of the electric insulation covering the outer circumference of the inductor winding ensure that the required minimum creepage distance is kept between the end faces of the inductor winding and the metallic inductor housing. Here, the relevant ways from the end faces of the inductor winding to the metallic inductor housing are only those not passing through the electrically insulating material of the coil lids or the bobbin, assuming that the electrically insulating material of the coil lids and the bobbin is of a sufficient dielectric strength. Therefore, in the inductor assembly according the present disclosure the design of the coil lids, in particular their overlap with adjacent areas of the electric insulation covering the outer circumference of the inductor winding, influences the creepage distance between the inductor coil and the metallic inductor housing. This in turn generates an option to a targeted modification of the creepage distance via a variation of the coil lid design without a significant increase of an installation space required by the inductor assembly. This will be explained in more detail in the following Figures.

Keeping the required minimum creepage distance, i. e. the minimum distance along insulator surfaces between the end faces of the inductor winding and the metallic inductor housing will ensure that a minimum clearance distance, i. e. a distance via any path through the air is also kept between the end faces of the inductor winding and the metallic inductor, if there is any such path through air in the inductor assembly according to the present disclosure at all.

The present disclosure does not rely on any dielectric strength of the potting material. Instead, by keeping the minimum creepage distances for all points of the end faces of the inductor winding, the potting material only provides an additional electric insulation. Further, keeping the minimum creepage distance by means of the coil lids means that the inductor winding as such may be arranged at a very small distance to the metallic inductor housing. As a result, the small distance between the inductor winding and the metallic inductor housing provides for a good thermal coupling between these components. The present disclosure also does not—at least not significantly—rely on a thermal conductivity of the potting material. This is due to the fact, that the inductor assembly of the present disclosure provides a significant heat transfer to the metallic inductor housing via paths not directed through the potting material, but through heat transfer enhancing interfaces as will be explained in more detail in the following. Therefore, the potting material does not necessarily need a filler of thermally conductive particles in order to provide a sufficient thermal conductivity of the potting material. Without the filler of thermally conductive particles within the potting material the risk of a dielectric breakdown triggered by that filler is eliminated, too. In addition, the potting material typically is cheaper in case it does not have to provide a sufficient thermal conductivity.

Additionally, the coil lids, in several aspects, may aid in producing the inductor assembly of the present disclosure. One of these aspects is arranging the inductor coil with regard to the metallic inductor housing. Another aspect is arranging the inductor coil with regard to other inductor coils and/or a magnetic core of the inductor assembly.

In the inductor assembly according to the present disclosure, the potting material may, for example, be optimized for a low viscosity in its fluid state so that even small gaps between the inductor coil and the metallic inductor housing are securely filled. Due to the small width of these gaps, the thermal conductivity of the potting material is not as important as in case of wider gaps. Of course, one may optimize the gap width and the thermal conductivity of the potting material for an optimum thermal coupling of the inductor coil to the metallic inductor housing considering the cost of the potting material and of the step of filling it into the metallic inductor housing.

In addition to keeping a required minimum creepage distance between all points of the end faces of the inductor winding towards the metallic inductor housing, this required minimum creepage distance may also be kept towards a magnetic core on which the bobbin of the inductor coil is arranged.

The value of the required minimum creepage distance will depend on the actual application of the inductor assembly and several parameters like; e.g., the potential difference between respective components, the impurities within and at the surface of the potting material and/or the environmental conditions which are present during the operation of the respective components typically have to be considered. Suitable values of the required minimum creepage distance are known to those skilled in the art. For example, the absolute value of the required minimum creepage distance between an uninsulated live component and the walls of a metal enclosure may be 1.6 mm, 6.4 mm or 12.7 mm depending on peak values of the potential difference between the component and the metal enclosure.

In the inductor assembly according to the present disclosure, the coil lids may actually contact the metallic inductor housing. In this way, they may be used for aligning the inductor coil within the metallic inductor housing prior to filling in the potting material, for example.

In the inductor assembly according to one embodiment of the present disclosure, the coil lids—or the coil lids together with the bobbin—may completely cover the end faces of the inductor winding, to electrically insulate the entire end faces by the electrically insulating material of the coil lids and the bobbin. It is clear that the coil lids and the bobbin will have to overlap to provide the required minimum creepage distance between the end faces and all points at the outside of this cover. In such an embodiment, an electric contact between the electric conductor of the inductor winding and outer electric or electronic components can be routed between the coil lid and the electric insulation covering the outer circumference of the inductor winding.

In another embodiment of the present disclosure, the coil lids or the coil lids together with the bobbin completely cover the end faces of the inductor winding only except of an electric contact window providing access to the inductor winding. This electric contact window may particularly be used for connecting the electric conductor of the inductor winding to outer electric or electronic components within an appliance in which the inductor assembly according to the present disclosure is used. It is clear that a distance of any point of the electric contact window to the metallic housing, and the magnetic core, if provided, along any path not passing through the electrically insulating material of the coil lids or of the bobbin is also at least the required minimum creepage distance.

This creepage distance of the electric contact window may, for example, be provided in that the electric contact window, particularly towards the magnetic core, is at least partially framed by continuous ribs of the bobbin extending through an opening in the adjacent coil lid. Alternatively or additionally, the electric contact window may be shielded, particularly towards the metallic housing, by a rib of the adjacent coil lid.

In the inductor assembly according to the present disclosure, the coil lids cover areas of the electric insulation covering the outer circumference of the inductor winding that are adjacent to the end faces of the inductor winding. This, however, does not mean that the coil lids completely cover the entire electric insulation covering the outer circumference of the inductor winding. Instead, the coil lids particularly do not cover those areas of the electric insulation which are not close to the end faces but close to the metallic inductor housing. Thus, these uncovered areas of the electric insulation are not thermally decoupled from the metallic inductor housing by the electric insulation material of the coil lids but may be particularly well thermally coupled to the metallic inductor housing for a quick transfer of heat from the inductor winding to the metallic inductor housing. In particular, the thermal coupling can be realized via a direct contact of the uncovered areas of the electric insulation with a heat transfer enhancing element concurrently thermally coupled to the metallic inductor housing.

In one embodiment of the inductor assembly according to the present disclosure, the electric insulation of the outer circumference of the inductor winding is provided by a continuous insulation foil enclosing the outer circumference of the inductor winding. The electric conductor winding may be a conductor foil, and the conductor foil may be wound on the bobbin together with the insulation foil in such a way that the insulation foil extends beyond the conductor foil in axial direction, i.e. at both end faces of the inductor winding, in order to prevent a short circuit of adjacent layers of the inductor winding. The continuous insulation foil may, however, also enclose an inductor winding made of a lacquered electric conductor like for example a lacquered wire. In lower temperature applications, the insulation foil may be a thermoplastic tape of polyvinylchloride, polyethylene or rubber. In higher temperature applications, the insulation foil may be an insulation paper. The thicknesses of a suitable insulation foil will typically be in a range from 25 □m to 100 □m.

To enhance the heat transfer from the outer circumference of the inductor winding to the metallic inductor housing, at least one heat transfer enhancing interface may be provided between an area of the electric insulation covering the outer circumference of the inductor winding—and not covered by the coil lids—, and the metallic inductor housing. This heat transfer enhancing interface may, for example, comprise a metallic belly band wound around the circumference of the inductor winding. Alternatively or additionally, the heat transfer enhancing interface may be of a "C" shape only covering those three sides of the outer circumference of the inductor winding facing inner surfaces of a pot-shaped metallic inductor housing. Alternatively to a metallic belly band also a belly band made out of another material with good thermal conductivity can be used.

When the bobbin of the inductor coil is arranged on a magnetic core, there may, additionally or alternatively, at least be one heat transfer enhancing interface provided between an area of the magnetic core and the metallic inductor housing. If, during an operation of the inductor assembly no potential difference occurs between the metallic inductor housing and the magnetic core, like this is the case, e.g., with a PE-grounded metallic inductor housing and a PE-grounded magnetic core, the at least one heat transfer enhancing interface advantageously can be a metallic element, which directly contacts the magnetic core and the metallic inductor housing and therefore provides an electrical conductivity between the magnetic core and the metallic inductor housing. If, on the other hand, during an operation of the inductor assembly a potential difference between the metallic inductor housing and the magnetic core occurs, an indirect contact ensuring a good thermal coupling is advantageously combined with a sufficient electric insulation between both components. Such an indirect contact prevents an electric connection between the metallic inductor housing and the magnetic core and can be provided by a thin insulation layer like, e.g. a lacquer or a thin insulation foil covering the outer surface of the magnetic core and/or the metallic inductor housing. A small gap between both components, advantageously filled with potting material, can also be used. When the bobbins of two inductor coils are coaxially arranged on the magnetic core, the at least one heat transfer enhancing interface may extend into an axial gap between the facing end faces of the inductor windings of the two inductor coils.

When the bobbins of two inductor coils are arranged on parallel legs of a magnetic core, i. e. side by side, a heat transfer enhancing interface may—alternatively or additionally—be provided between facing areas of the electric insulations covering the outer circumferences of the inductor windings of the two inductor coils. Such a heat transfer enhancing interface is typically plate-shaped.

In the inductor assembly according to the present disclosure, any heat transfer enhancing interface may either be a protrusion or extension of the metallic housing or a separate element located within the metallic inductor housing. Such a separate element may, nevertheless, be attached, mounted or bonded to the metallic inductor housing, or it may be attached, mounted or bonded to the inductor coil or any component placed in the metallic inductor housing together with the inductor coil. For example, it may be a C-shaped element clipped onto the electric insulation covering the outer circumference of the inductor winding of the inductor coil. The material of the separate element may be any material of high thermal conductivity including insulators like, for example, aluminium nitride, aluminium oxide and diamond, and electrical conductors like, for example, aluminium, copper, brass, graphite, etc., or even iron if additional magnetic parameters are desired.

In the inductor assembly of the present disclosure, the two end faces of the inductor winding of each inductor coil are covered by two separate coil lids. However, these two coil lids may also cover the end faces of a second inductor coil arranged side by side with the at least one inductor coil. The facing end faces of two adjacent inductor windings of two coaxially arranged inductor coils, on the other hand, will be covered by two separate coil lids. The separate coil lids, however, may be configured such as to mutually engage each other in a predefined way such as to align the two coaxially arranged inductor coils and/or to keep a predefined distance between them, for example. They may also be configured to hold a section or leg of a magnetic core of the inductor assembly.

Advantageous developments of the disclosure result from the claims, the description and the drawings. The advantages of features and of combinations of a plurality of features mentioned at the beginning of the description only serve as examples and may be used alternatively or cumulatively without the necessity of embodiments according to the disclosure having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the disclosure or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the disclosure do not have the features mentioned in the claims.

The number of the features mentioned in the claims and in the description is to be understood to cover this exact number and a greater number than the mentioned number without having to explicitly use the adverb "at least". For example, if an inductor coil is mentioned, this is to be understood such that there is exactly one inductor coil or there are two inductor coils or more inductor coils. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the disclosure is further explained and described with respect to the example embodiments illustrated in the drawings.

DESCRIPTION OF THE DRAWINGS

The present disclosure relates to an inductor assembly comprising at least one inductor coil, a metallic inductor housing at least partially enclosing the inductor coil, and a potting material both contacting the inductor coil and the inductor housing and thermally coupling the inductor coil to the inductor housing. More particular, the present disclosure relates to such an inductor assembly in which the at least one inductor coil includes a bobbin made of electrically insulating material and an inductor winding made of an electric conductor wound on the bobbin, wherein the inductor winding has an outer circumference and two end faces, and wherein an electric insulation covers the outer circumference of the inductor winding.

Figure 1:
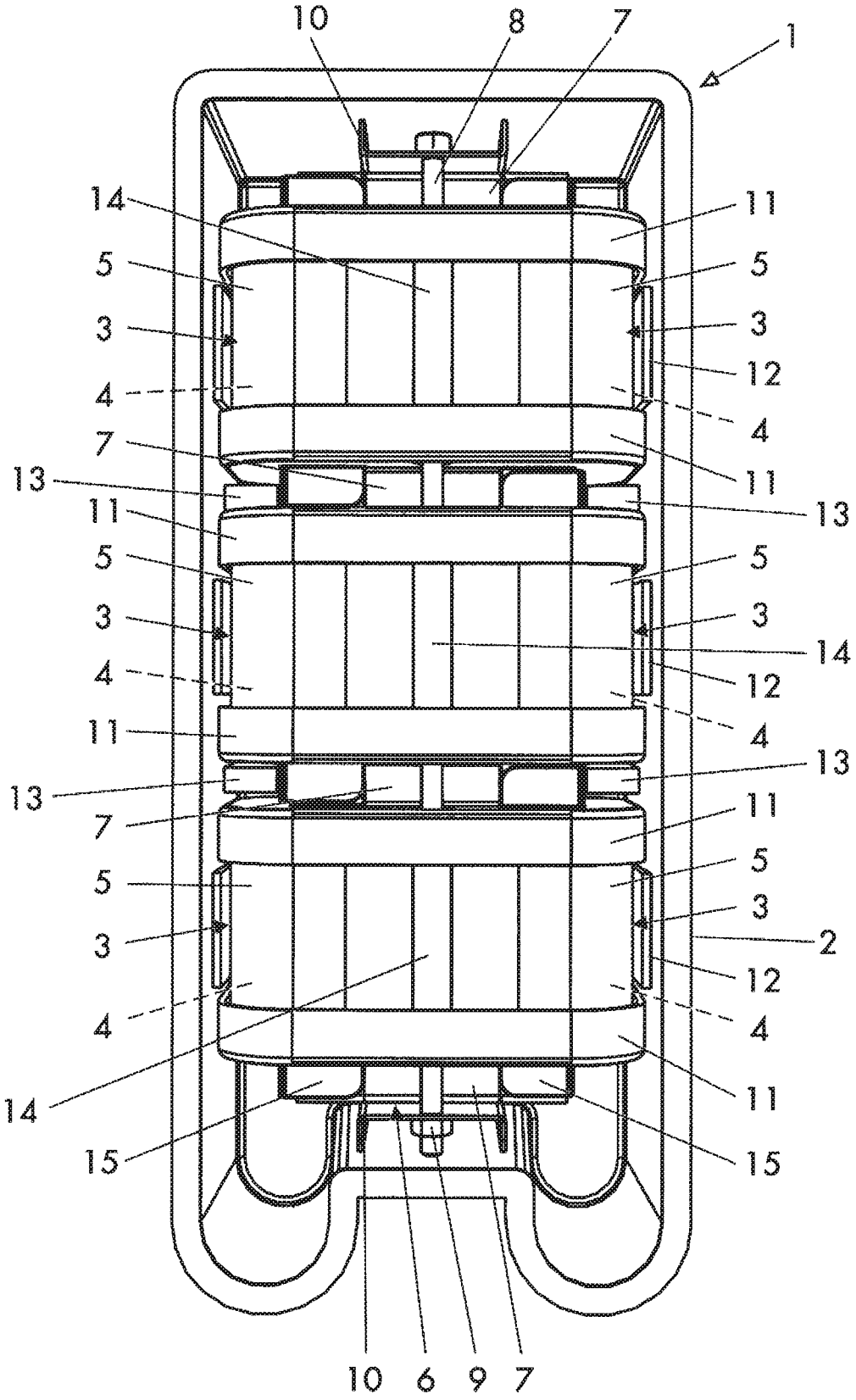
FIG. 1 is a top view on a first embodiment of an inductor assembly according to the present disclosure, before filling a potting material in a metallic inductor housing of the inductor assembly.

FIG. 1, in a top view, shows an inductor assembly 1 before filling a potting material into a metallic inductor housing 2 enclosing a plurality of inductor coils 3. Here, six inductor coils 3 are depicted. Each conductor coil 3 comprises an inductor winding 4 covered by an electric insulation 5 made of a continuous insulation foil. The electric conductor of each inductor winding 4 is wound on a bobbin not in the view of FIG. 1. The bobbins of all six inductor coils 3 are arranged on a common magnetic core 6 consisting of longitudinal sections each extending within one of the bobbins and perpendicular sections 7. The longitudinal sections are arranged in parallel pairs. These pairs are separated by the perpendicular sections 7, and further perpendicular sections 7 are arranged at both ends of the magnetic core 6. The sections of the magnetic core 6 are held together by two headed pulling screws 8 which extend through end elements 10 and onto which nuts 9 are screwed. The basic arrangement of the inductor coils 3 on the common magnetic core 6 of the inductor assembly 1 may be the same as disclosed in WO 2013/170906 A1.

The end faces of the inductor windings 4 of each pair of inductor coils 3 arranged side by side on one parallel pair of longitudinal sections of the magnetic core are covered by a pair of coil lids 11 made of electrically insulating material which may be the same as an electrically insulating material of the bobbins of the inductor coils 3. The coil lids 11 also cover areas of the outer circumferences of the inductor windings 4 covered by the electric insulation 5. The coil lids 11 thus ensure that all points of the end faces of the inductor windings 4 keep a required minimum creepage distance and also a minimum clearance distance to the metallic inductor housing 2. Together with the bobbins carrying the inductor windings 4, the coil lids 11 also ensure that the required minimum creepage distance and the minimum clearance distance is kept with regard to the magnetic core 6, particularly with regard to the perpendicular segments 7 of the magnetic core 6.

The coil lids 11, however, do not cover a main part of the electric insulation 5 and thus of the outer circumference of the inductor windings 4. Instead, heat transfer enhancing interfaces 12 thermally couple this main part of the outer circumference of the inductor windings 4 which remains uncovered by the coil lids 11 to the metallic inductor housing 2. Further heat transfer enhancing interfaces 13 extend between each pair of coaxially arranged inductor coils 3 to thermally couple the magnetic core 6 to the metallic inductor housing 2. Additional heat transfer enhancing interfaces 14 extend between the facing outer circumferences of the inductor windings 4 of each pair of inductor coils 3 arranged side by side and thermally couple the adjacent areas of the outer circumferences of the inductor windings 4 to the bottom of the metallic inductor housing 2. The pulling screws 8 extend through and fix these heat transfer enhancing interfaces 14. The coil lids 11 comprise core holding extensions 15 partially enclosing and thus holding the perpendicular sections 7 of the magnetic core 6. The core holding extensions 15 of facing coil lids 11 covering the end faces of axially neighboring inductor coils 3 are configured in such a way that they mutually overlap in axial direction. By designing dedicated form fitting elements on the core holding extensions 15 it is also possible to ensure a predefined distance between axially neighboring inductor coils 3.

The inductor assembly 1 according to FIG. 1 is not yet finished. It will be finished by filling in a potting material enclosing the inductor coils 3 within the metallic inductor housing 2 and thermally coupling the inductor coils 3 to the metallic inductor housing 2. Further, electric contacts to the inductor windings 4, which extend through the potting material once filled into the inductor housing 2 are not depicted in FIG. 1. Particularly, contact wires to the inductor windings 4 may extend from the end faces of the inductor windings 4 between the coil lids 11 and the electric insulation 5 and may then be bent upwards to lead out of the potting material. The thermal coupling provided by the heat transfer enhancing interfaces 12, 13, 14 ensure an optimized heat transfer from the inductor coils 3 to the metallic inductor housing 2. In addition, the heat transfer does not rely on a thermal conductivity of the potting material since it is not governed by the potting material. As a consequence the potting material can be designed to primarily have a low viscosity in order to fill small gaps during the potting process.

Figure 2:
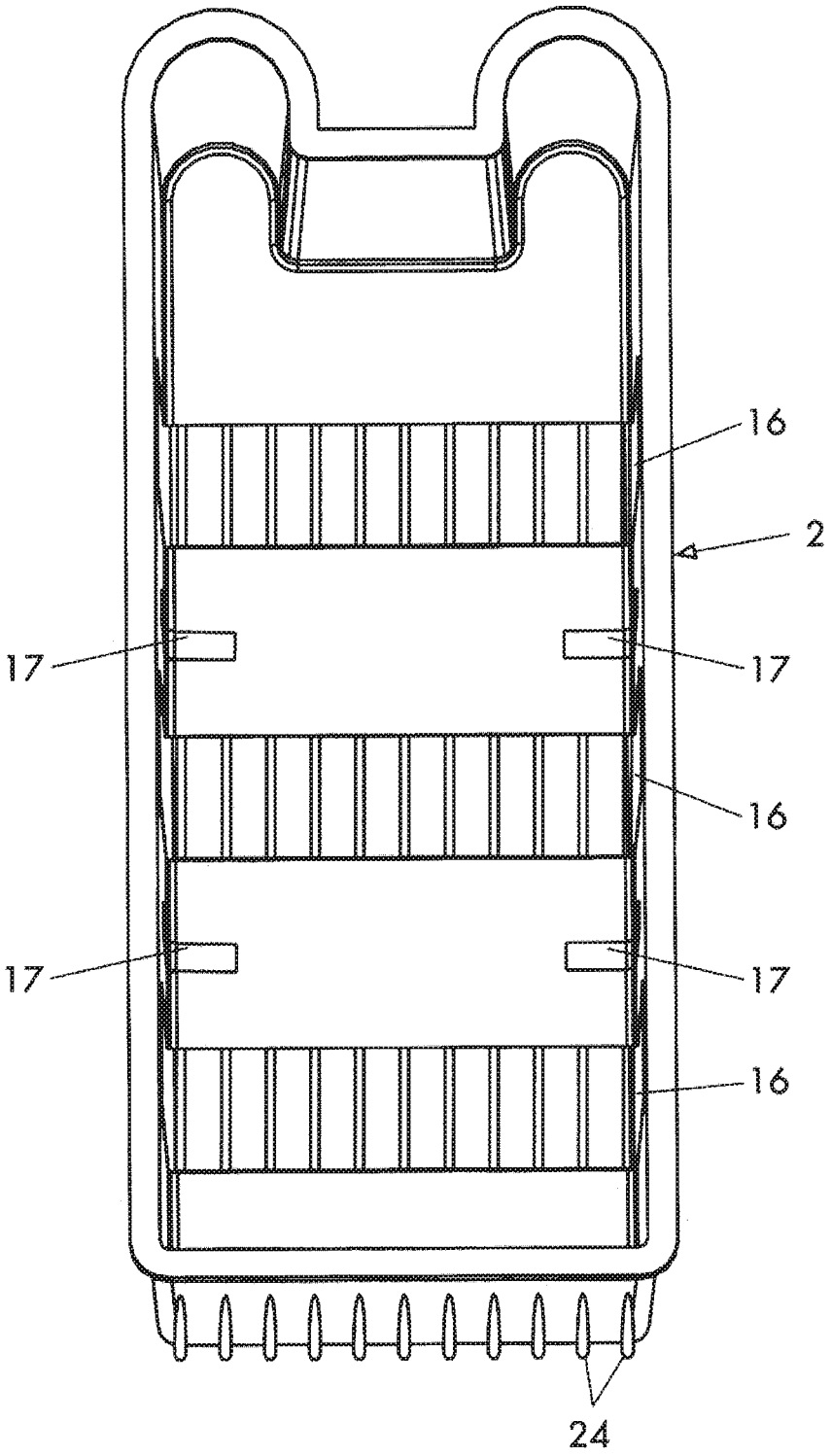
FIG. 2 separately depicts the pot-shaped metallic inductor housing of the inductor assembly according to FIG. 1.

The inductor housing 2 separately depicted in FIG. 2 comprises cooling ribs 24 at its outside. At its inside, the inductor housing 2 comprises contact areas 16 and 17 for the heat transfer enhancing interfaces 12 and 13. In these contact areas 16 and 17 the metallic inductor housing 2 may be covered by some heat transfer material, such as a heat transfer paste, prior to inserting the heat transfer enhancing interfaces, and/or the heat transfer enhancing interfaces 12 and 13 may be bonded to the contact areas 16 and 17.

Figure 3:
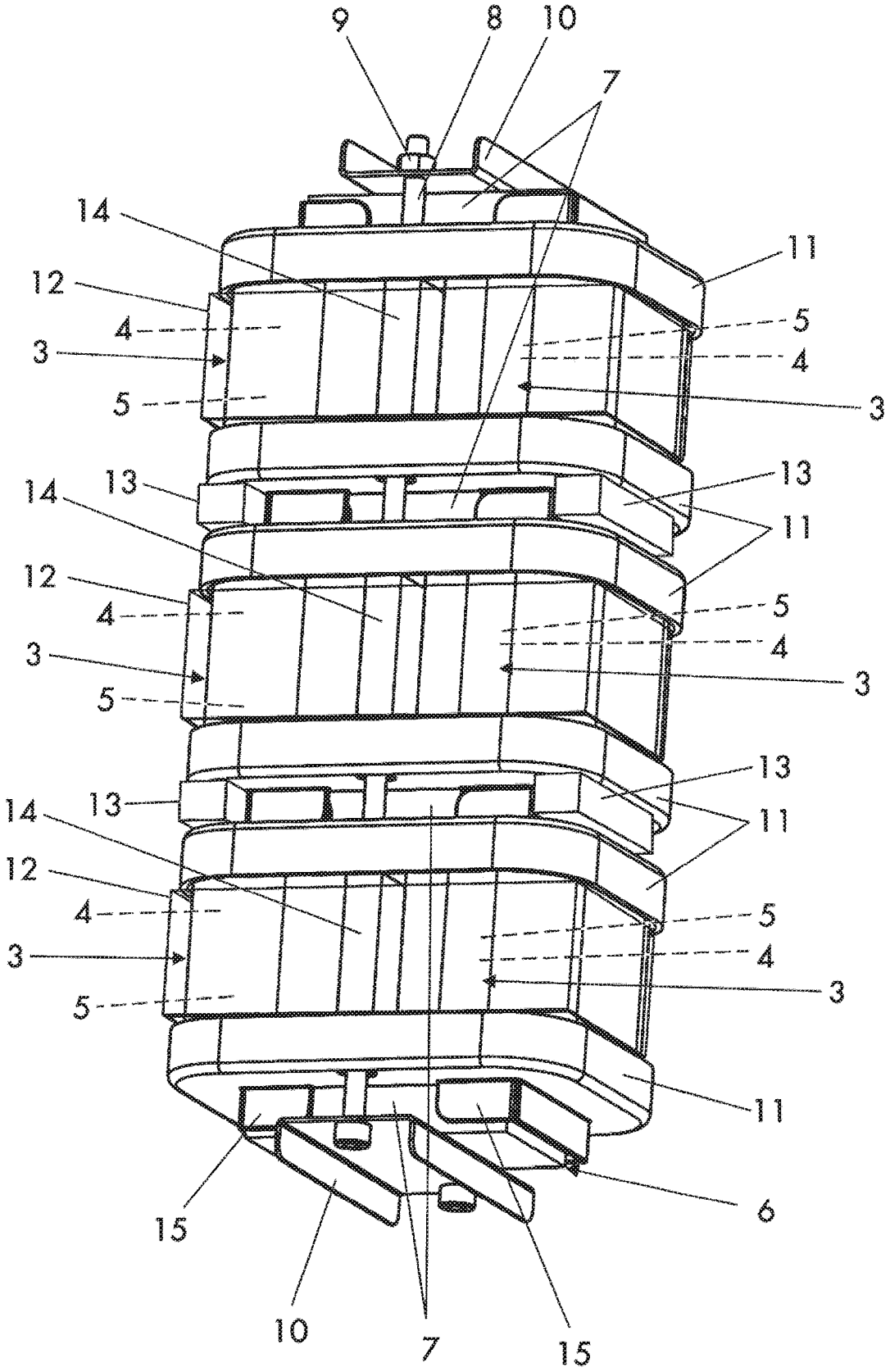
FIG. 3, in perspective view from below, separately depicts all components of the inductor assembly of FIG. 1 except of the metallic inductor housing according to FIG. 2.

The perspective bottom view according to FIG. 3 shows the location of the heat transfer enhancing interfaces 12 and 13 with regard to the inductor windings 4 and the magnetic core 6. Instead of the C-shaped heat transfer enhancing interfaces 12, each pair of inductor coils 3 arranged side by side could be provided with a continuous metallic belly band.

Figure 4:
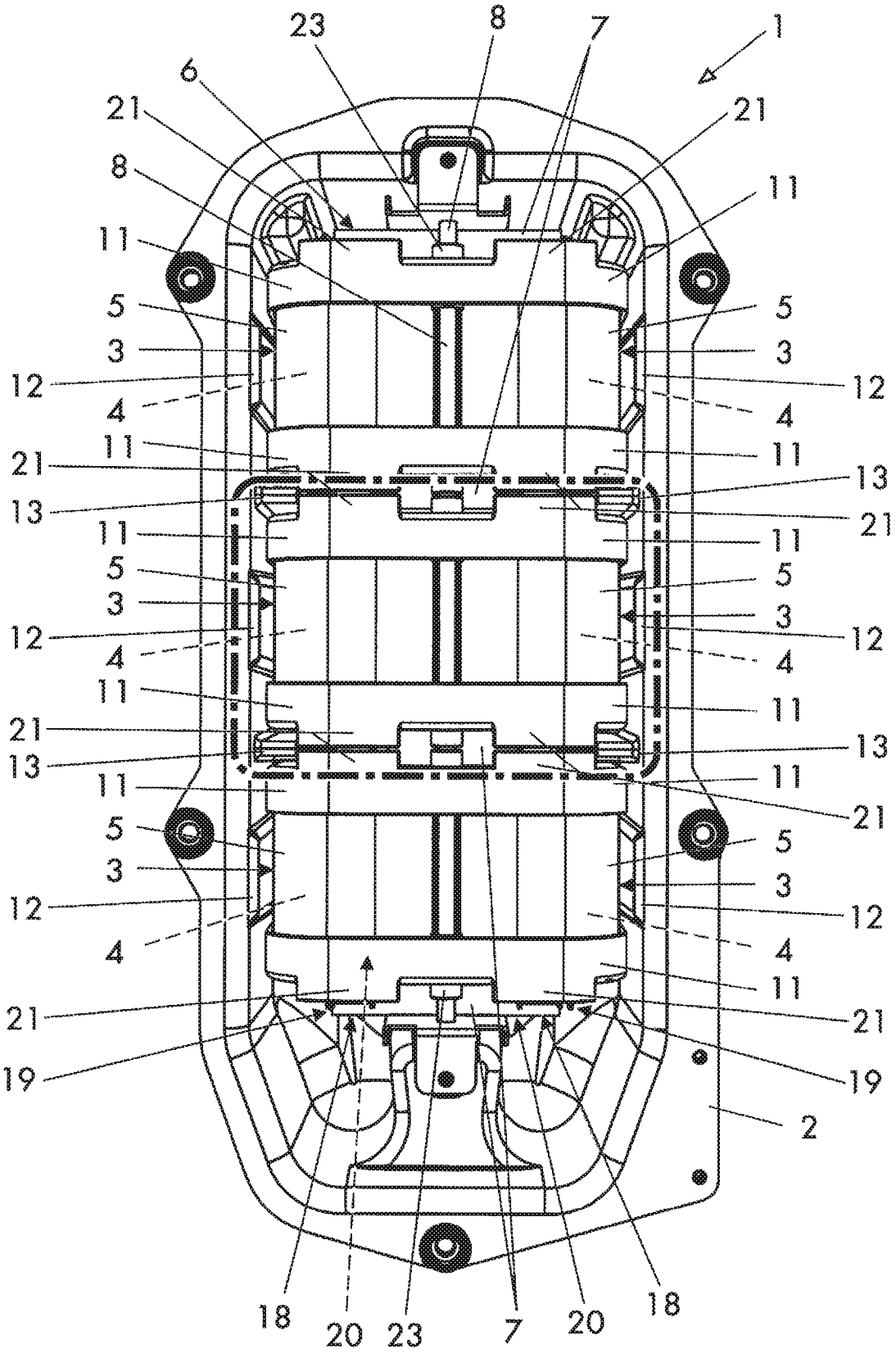
FIG. 4 is a top view on another embodiment of the inductor assembly according to the present disclosure before filling the potting material in its metallic inductor housing and closing its metallic inductor housing with a metallic closure plate.

The embodiment of the inductor assembly 1 according to FIG. 4 comprises a metallic inductor housing 2 which is to be closed by a metallic closure plate or any other metallic closure not depicted here. Further, electric contact windows 18 are provided for contacting the inductor windings 4 of the inductor coils 3. One pair of the inductor coils 3 covered by common coil lids 11 is separately depicted in FIGS. 5 and 6 which show the following details. Towards the magnetic core 6, the electric contact windows 18 are framed by ribs 19 of the bobbins 20, to keep the required minimum creepage and clearance distances of any point of the electric contact windows 18 towards the magnetic core 6. Towards the metallic closure plate of the metallic inductor housing 2, the electric contact windows 18 are shielded by ribs 21 of the adjacent coil lids 11 to also keep the required minimum creepage and clearance distances of any point of the electric contact windows 18 towards the metallic closure plate. Here, keeping the minimum clearance distance will be the more important aspect. Advantageously the ribs 21 of adjacent coils lids 11 mutually engage and/or overlap each other. Instead of keeping a predefined distance between axially neighbored inductor coils 4 by using a direct contact between form fitting elements of the core holding extensions 15 of adjacent coil lids 11, it is alternatively or cumulatively also possible to keep said predefined distance by using a direct contact between form fitting elements located at the ribs 21 of adjacent coil lids 11. These details may even be better visible from FIG. 8 described below. The coil lids 11 additionally comprise tube-shaped protrusions 23 encircling the pulling screws 8 where they extend through the coil lids 11. This ensures that the required minimum creepage and clearance distances of all points of the end faces of the inductor windings 4 are also kept towards to the pulling screws 8. Further, the heat transfer enhancing interfaces 14 only extend between the pulling screws 8 here, i.e. they are not provided with through holes for the pulling screws 8 like in the embodiment of FIGS. 1 to 3. They nevertheless transport heat from between the two neighboring inductor coils 3 towards the metallic inductor housing 2.

Figure 5:
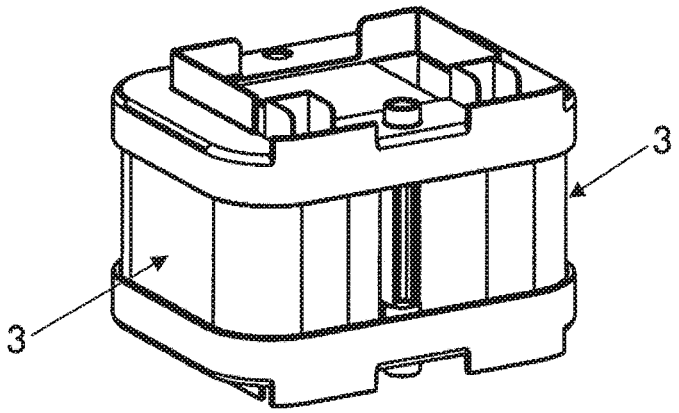
FIG. 5 separately depicts one pair of inductor coils of the inductor assembly according to FIG. 4 encircled by a dashed-dotted line in FIG. 4.
Figure 6:
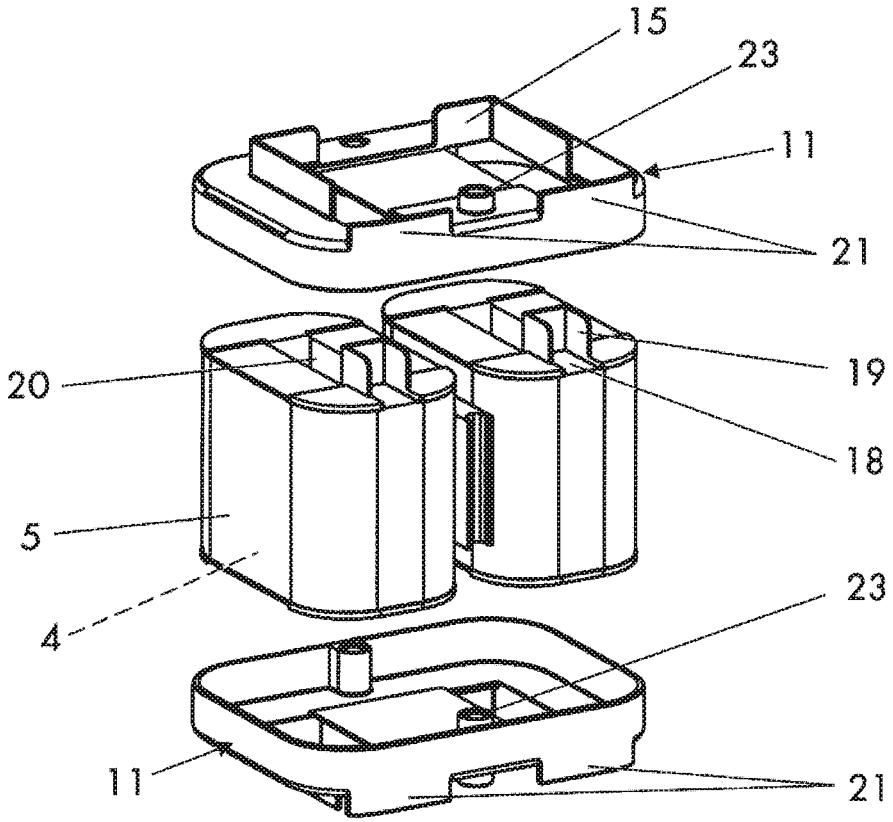
FIG. 6 is an exploded view of the pair of inductor coils according to FIG. 5.

In FIG. 5 and FIG. 6 it is illustrated that the coil lid 11 is configured to be attached to the inductor coils 3 in an axial direction of the inductor coils 3. In other words, looking on the illustrated embodiments each coil lid 11 is attached to the respective end faces 27 of the inductor coils 3 from an upper and from a lower side. Therefore, it is ensured via the coil lids 11 that the two parallel oriented inductor coils 3 are positioned relative to each other in a predefined axial direction. A coil lid 11 that is attached to their respective inductor coils 3 from an axial direction of the inductor coils 3 is shown for a common coil lid 11 simultaneously attached to two inductor coils 3. However, also a coil lid 11 for a single inductor coil 3 is preferably attached to the inductor coil 3 from an axial direction of the inductor coil 3. The coil lid 11 may be formed as a cup-like structure entirely covering side faces of the bobbin 20 with only an opening for the core 6, and providing the desired overlap over the electric insulation 5, or as a ring-like structure covering just a sufficiently large outer portion of the bobbin's 20 side faces and providing the desired overlap. Other forms may also be contemplated.

Figure 7:
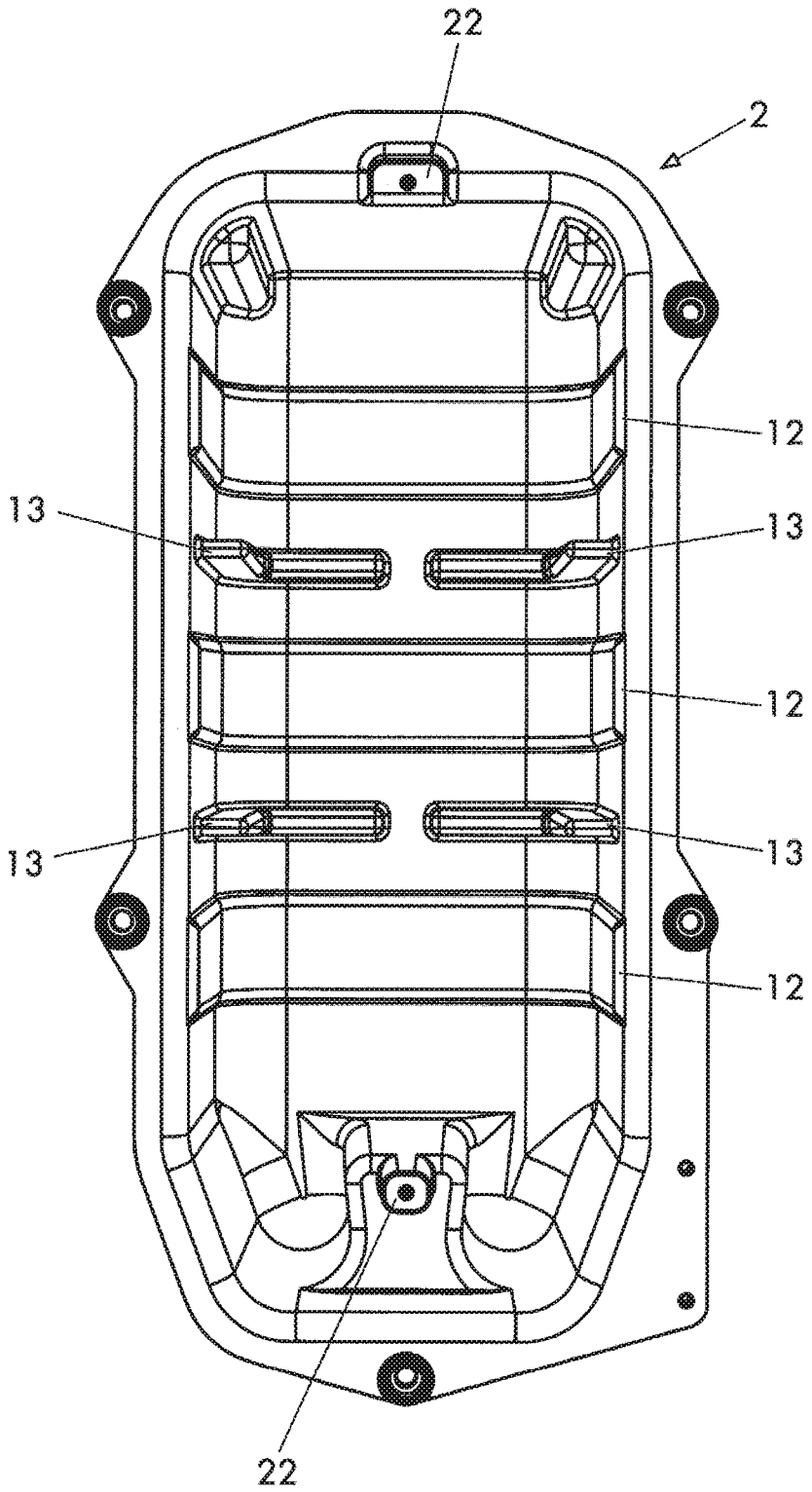
FIG. 7 separately depicts the pot-shaped metallic inductor housing of the inductor assembly according to FIG. 4.

FIG. 7 shows in more detail that the heat transfer enhancing interfaces 12 and 13 are one part with the metallic inductor housing 2 here. Further, mounting points 22 are provided to screw mount the sub-assembly according to FIG. 6 to the metallic inductor housing 2 according to FIG. 4.

Figure 8:
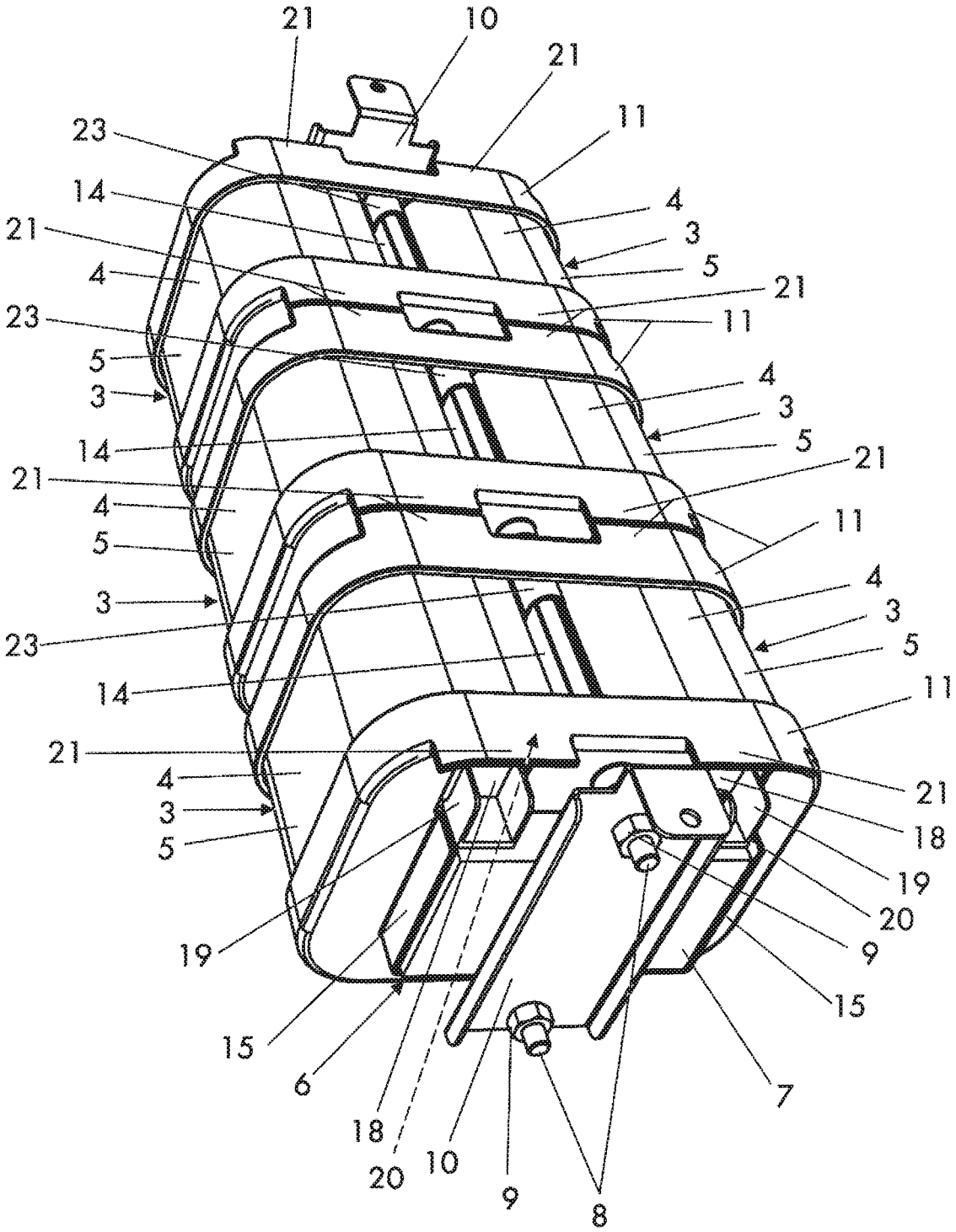
FIG. 8, in a perspective view, separately depicts all components of the inductor assembly shown in FIG. 4 except of the metallic inductor housing part shown in FIG. 7.

FIG. 8 is a perspective view of the inductor coils 3 arranged on their common magnetic core 6 according to FIG. 4 except the metallic inductor housing 2. Here the whole arrangement of the inductor coils 3 and their common magnetic core 6 is fixed by the end elements 10, pulling screws 8 and nuts 9 prior to inserting the inductor coils 3 into the metallic inductor housing 2.

Figure 9:
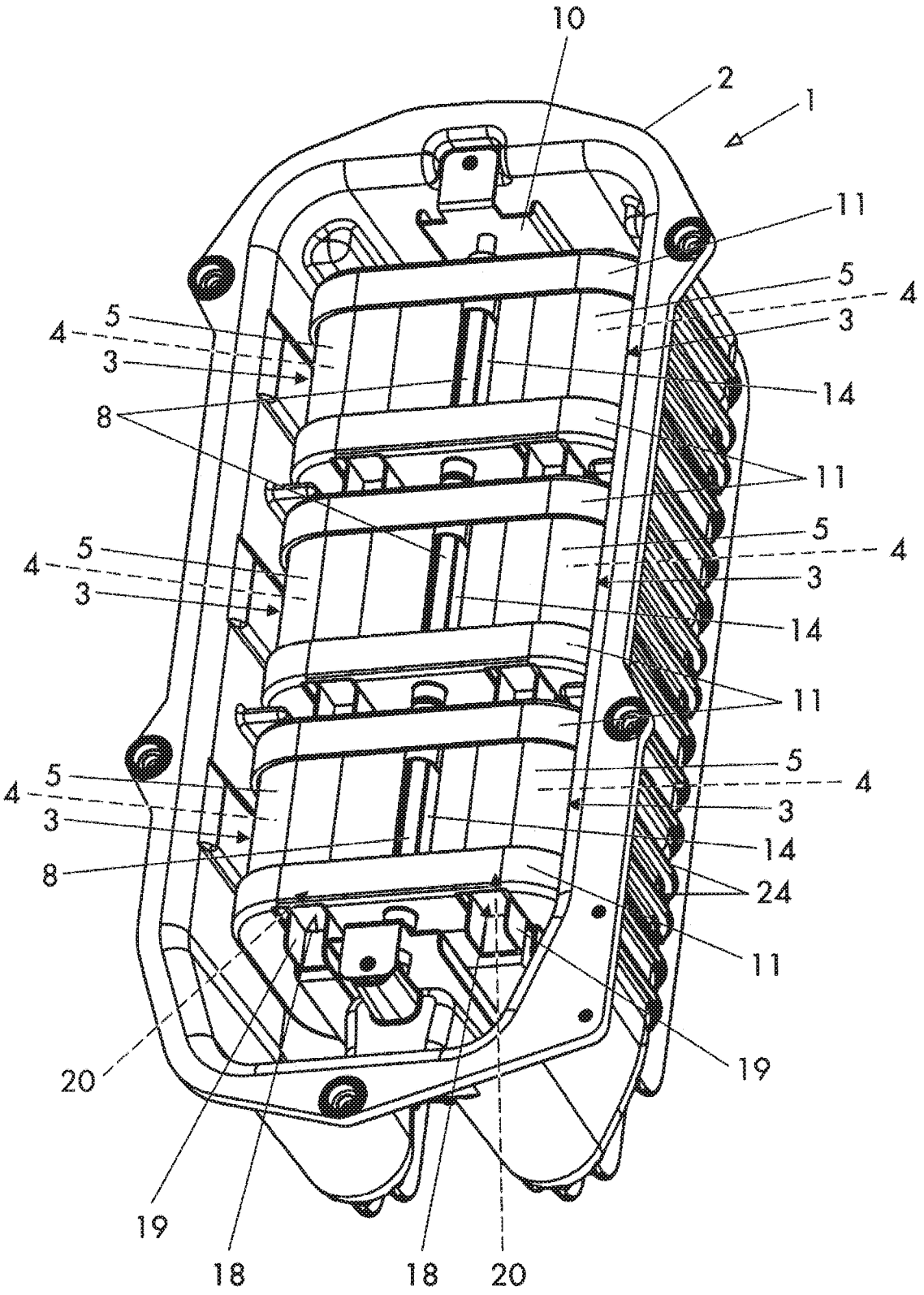
FIG. 9 is a perspective top view on a further embodiment of the inductor assembly according to the present disclosure before filling the potting material in its metallic inductor housing.

The embodiment of the inductor assembly 1 according to FIG. 9 is similar to that one depicted in FIGS. 4 to 8. The only difference is that the electric contact windows 18 are not shielded by the ribs 21 of the coil lids 11 towards the open side of the metallic inductor housing 2 as no metallic closure plate will be used to close the metallic inductor housing 2 here.

Figure 10:
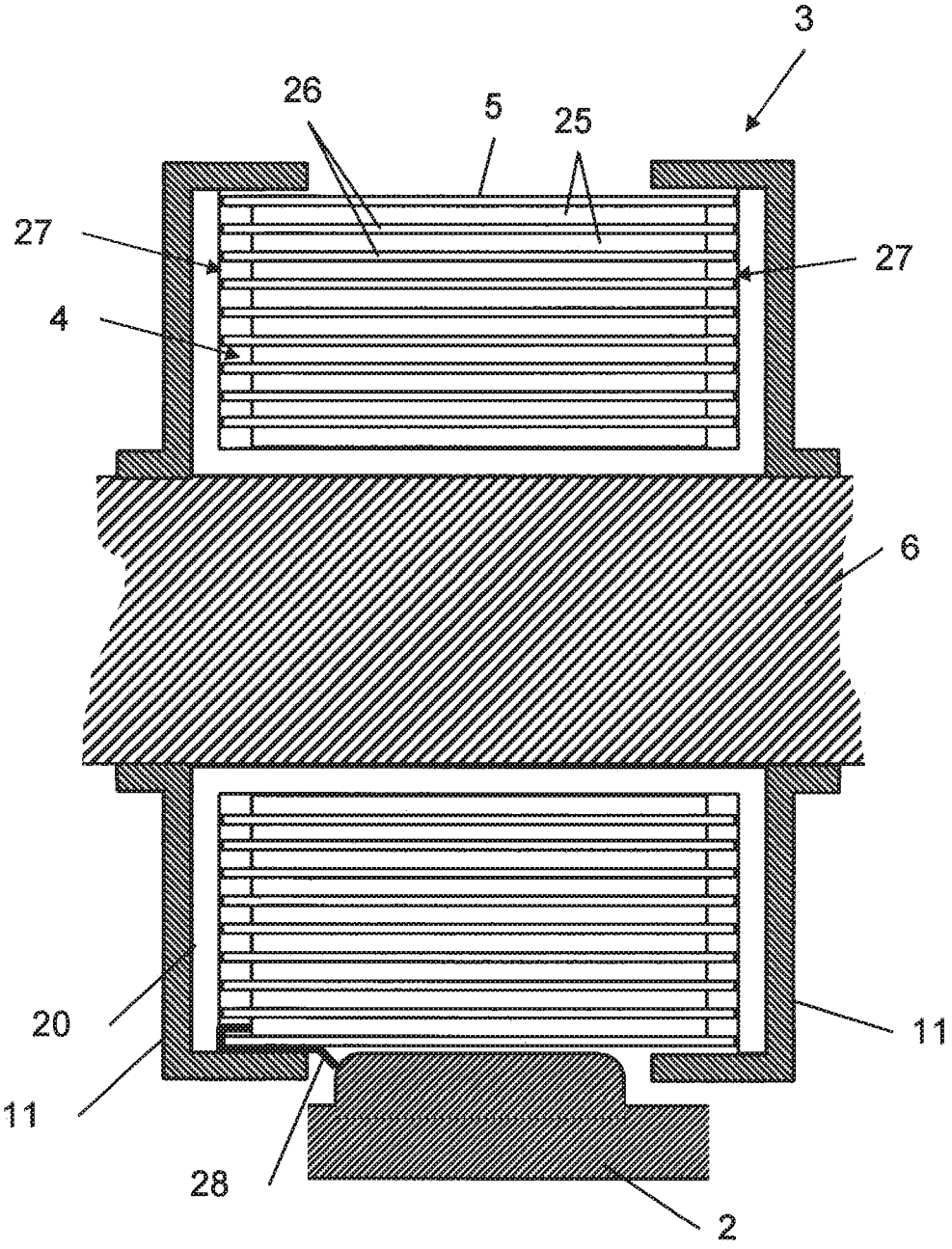
FIG. 10 is a longitudinal section through an inductor coil of an inductor assembly according to the present disclosure in a first embodiment.

FIG. 10 shows in greater detail, how the inductor winding 4 of an inductor coil 3 of an inductor assembly 1 according to the present disclosure may be wound around the bobbin 20. In the present embodiment, the electric conductor 25 of the inductor winding 4 is foil-shaped, and the individual layers of the electric conductor 25 are separated by an insulation foil 26. The insulation foil 25 made of electrically insulating material also forms the electric insulation 5 covering the outer circumference of the inductor winding 4. The width of the insulation foil 26 is greater than the width of the foil-shaped electric conductor 25, and at both end faces 27 of the inductor winding 4 the insulation foil 26 extends beyond the electric conductor 25. Thus, the individual layers of the electric conductor 25 are sufficiently electrically insulated from each other. For also providing a required minimum creepage distance 28 towards any metallic inductor housing in which the inductor coil 3 will be arranged, the coil lids 11 of electrically insulating material are provided in addition to the bobbin 20. Like the bobbins 20, the coil lids 11 are also made of electrically insulating material and, either alone or at least together with the bobbins 20, cover the end faces 27 of the inductor winding 4. The coils lids 11 also cover adjacent areas of the electric insulation 5 covering the outer circumference of the inductor winding 4. The described coverage of the coil lids 11 ensures that a distance of any point of the end faces 27 of the inductor winding 4 to the metallic housing 2 along any way not passing through the electrically insulating material of the coil lids 11 or the bobbin 20 is at least a required minimum creepage distance 28.

The creepage distance between two electric-conductor-parts typically is the shortest distance of any possible surface oriented path between these electric-conductor-parts not passing through any insulating bulk material but along insulator surfaces. In FIG. 10 one possible creepage distance between the inductor winding 4 and the metallic inductor housing 2 not passing through the electrically insulating material of the electric insulation 5, the bobbin 20 and the coil lid 11 is explicitly depicted by way of example. Via the design of the coil lids 11 said creepage distance 28 is kept longer than the required minimum creepage distance 28, which will be explained in more detail in the following:

By looking on FIG. 10, it becomes obvious that any creepage path that can occur—and in particular any creepage path starting from an end face 27 of the inductor winding 4—is directed along an overlap section between the coil lids 11 and the adjacent areas of the electric insulation 5 covering the outer circumference of the inductor winding 4. Therefore, by changing the overlap section the creepage distance can be purposely modified. For instance, decreasing the overlap section of the coil lid 11—and optionally also increasing the width of the heat transfer enhancing interface 12—leads to a decrease of the creepage distance, whereas increasing the overlap section of the coil lid 11—and optionally also decreasing the width of the heat transfer enhancing interface 12—leads to an increase of the creepage distance. Therefore, via changing the design of the coil lid 11 in particular with regard to its overlap section it can be ensured that any possible creepage path that can occur comprises the required minimum creepage distance 28. The value of the minimum creepage distance 28 depends on the individual application and in particular on peak values of the potential difference between the inductor coil 3 and the metallic inductor housing 2. The values of the minimum required creepage distance 28 are specified in specification documents and therefore are known by a person skilled in the art. The same principle explained above with regard to the creepage distance also applies to the clearance distance.

Figure 11:
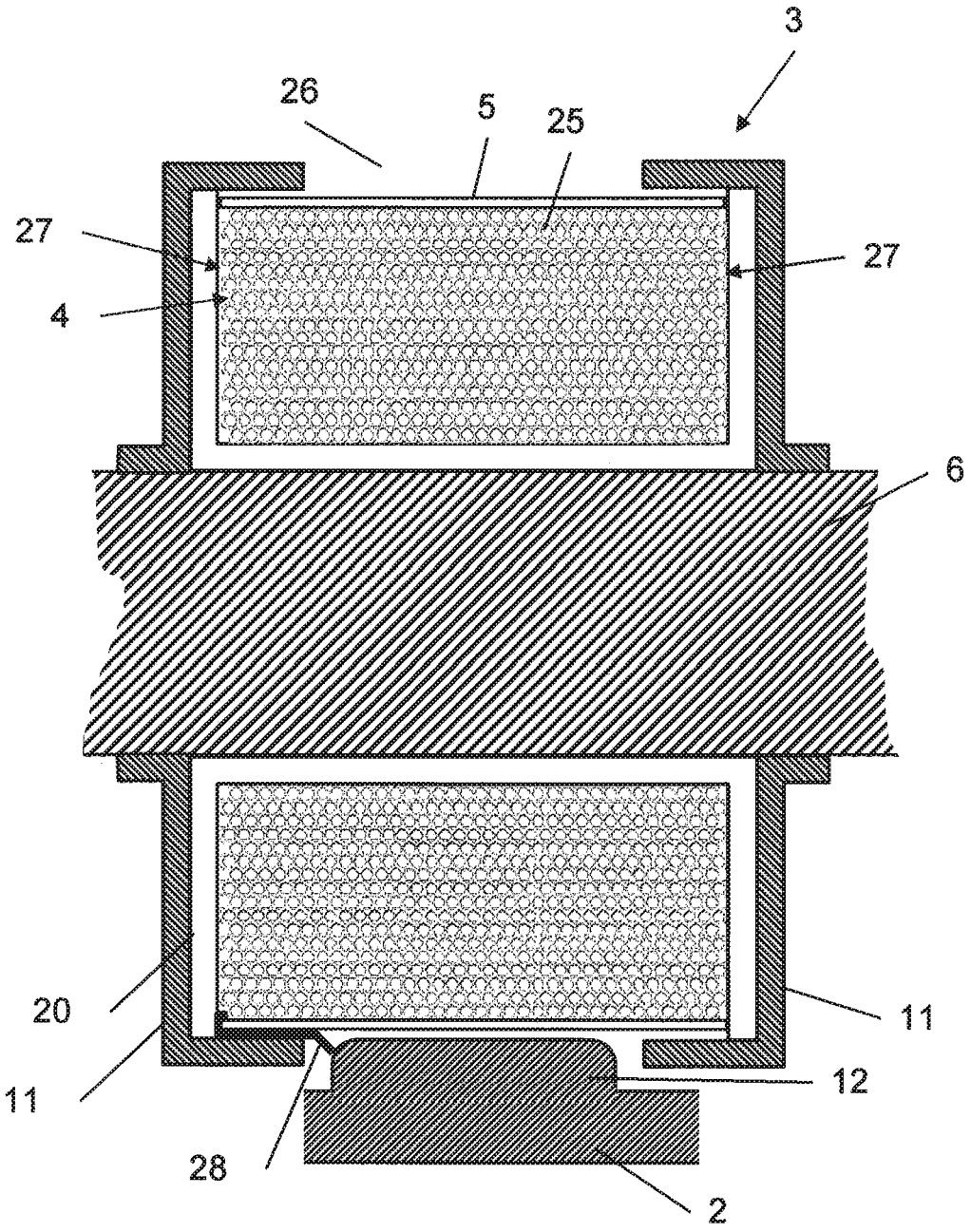
FIG. 11 is a longitudinal section through an inductor coil of the inductor assembly according to the present disclosure in a second embodiment.

In the embodiment of the inductor coil 3 of FIG. 11 the electric conductor 25 is a wire with a lacquer insulation. The lacquer insulation is sufficient for electrically insulating the individual turns of the wire with regard to each other. For the electric insulation of the outer circumference of the inductor winding 4, however, a separate electric insulation 5 made of an insulating foil is provided. Alternatively, the electric conductor 25 could be foil-shaped with a lacquer insulation insulating the individual turns of the wire with regard to each other and with a separate electric insulation 5 at the outer circumference of the inductor winding 4. The coil lids 11 again serve for ensuring a required minimum creepage distance 28 between the inductor winding 4, particularly considering the end face 27 of the inductor winding 4, and any metallic inductor housing 2 in which the inductor coil 3 is placed. The creepage distance between the end face 27 and such a metallic inductor housing again is that shortest distance between them not extending through the electrically insulating material of the electric insulation 5, the bobbin 20 and the coil lid 11.

Figure 12:
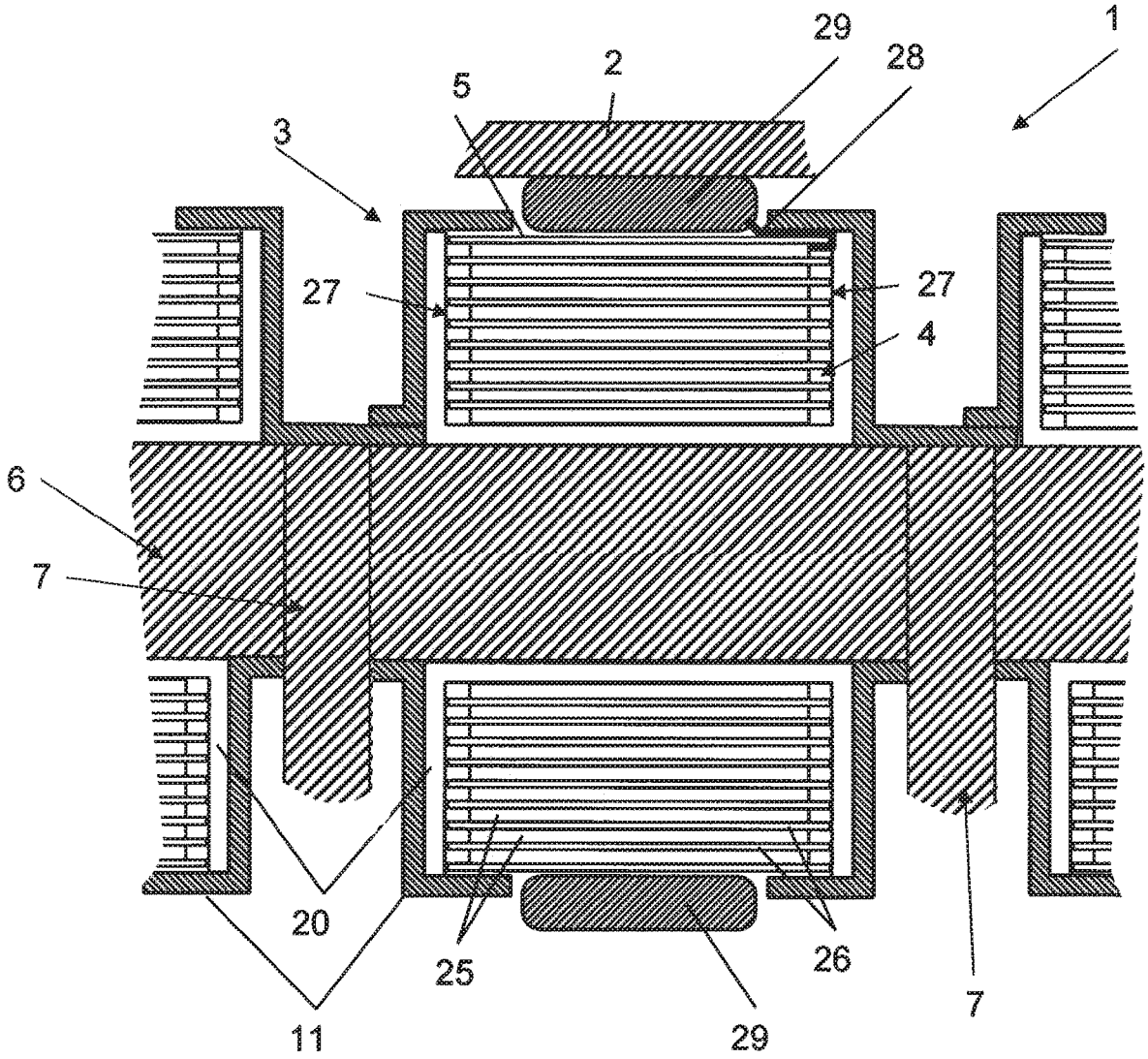
FIG. 12 is a partial longitudinal section through an inductor coil of an embodiment of the inductor assembly according to the present disclosure in which the position of a metallic inductor housing and the position of a magnetic core of the inductor assembly are indicated.

The embodiment according to FIG. 12 incorporates the embodiment of the inductor coil 3 of FIG. 10. Additionally, a metallic belly band 29 is depicted which may enclose the entire outer circumference of the inductor winding 4 not covered by the coil lids 11 at the outside of the electric insulation 5 and serves as a heat transfer enhancing interface 12 towards a metallic inductor housing 2 indicated in FIG. 12. This metallic belly band 29 does not affect the required minimum creepage distance 28 kept by means of the coil lids 11 towards the metallic inductor housing 2. The coil lids 11, together with the bobbin 20 also serve for keeping the required minimum creepage distance 28 towards the magnetic core 6, even there, where the perpendicular segment 7 of the magnetic core 6 runs along the end face 27 of the inductor winding 4.

Also the embodiments shown in FIG. 11 and FIG. 12 provide the option to purposely modify the creepage distance by changing the overlap section of the coil lid 11 and the adjacent areas of the electric insulation 5 covering the outer circumference of the inductor winding 4. Therefore, the modification principle of the creepage distance mentioned with regard to FIG. 10 can be also applied to the embodiments shown in FIG. 11 and FIG. 12.

The invention claimed is:

1. An inductor assembly comprising:

at least one inductor coil, the inductor coil including a bobbin made of electrically insulating material, and an inductor winding made of an electric conductor wound on the bobbin, the inductor winding having an outer circumference and two end faces, and an electric insulation covering the outer circumference of the inductor winding;

a metallic inductor housing at least partially enclosing the at least one inductor coil; and a potting material both contacting the inductor coil and the metallic inductor housing and thermally coupling the inductor coil to the metallic inductor housing, wherein coil lids made of electrically insulating material at least partially cover the end faces of the inductor winding and adjacent areas of the electric insulation covering the outer circumference of the inductor winding such that a distance of any point of the end faces of the inductor winding to the metallic inductor housing along any way not passing through the electrically insulating material of the coil lids or the bobbin is at least a required minimum creepage distance of 1.6 mm, 6.4 mm, or 12.7 mm.

2. The inductor assembly of claim 1, wherein the bobbin is arranged on a magnetic core, wherein a further distance of any point of the end faces of the inductor winding to the magnetic core along any way not passing through the electrically insulating material of the coil lids or the bobbin is at least the required minimum creepage distance.

3. The inductor assembly of claim 1, wherein the coil lids or the coil lids together with the bobbin completely cover the end faces of the inductor winding.

4. The inductor assembly of claim 1, wherein the coil lids or the coil lids together with the bobbin completely cover the end faces of the inductor winding except of an electric contact window providing access to the inductor winding.

5. The inductor assembly of claim 4, wherein the electric contact window is at least partially framed by ribs of the bobbin extending through an opening in the adjacent coil lid.

6. The inductor assembly of claim 4, wherein the electric contact window, towards the metallic inductor housing and/or towards a metallic closure plate of the metallic inductor housing, is shielded by a rib of the adjacent coil lid.

7. The inductor assembly of claim 1, wherein the coil lids only partially cover the electric insulation covering the outer circumference of the inductor winding.

8. The inductor assembly of claim 1, wherein the electric insulation of the outer circumference of the inductor winding is provided by a continuous insulation foil enclosing the outer circumference of the inductor winding, wherein the electric conductor is a conductor foil and that the conductor foil is wound on the bobbin together with the insulation foil, the insulation foil extending beyond the conductor foil in axial direction.

9. The inductor assembly of claim 1, wherein at least one heat transfer enhancing interface is provided between an area of the electric insulation covering the outer circumference of the inductor winding and the metallic inductor housing, wherein, optionally, the heat transfer enhancing interface comprises a metallic belly band around the circumference of the inductor winding.

10. The inductor assembly of claim 1, wherein the bobbin is arranged on a magnetic core, wherein at least one heat transfer enhancing interface is provided between an area of the magnetic core and the metallic inductor housing.

11. The inductor assembly of claim 1, wherein the bobbin comprises two bobbins of two inductor coils, respectively, arranged on parallel sections of the magnetic core, wherein at least one heat transfer enhancing interface is provided between facing areas of the electric insulations covering the outer circumferences of the inductor windings of the two inductor coils.

12. The inductor assembly of claim 9, wherein the heat transfer enhancing interfaces includes at least one of a protrusion of the metallic inductor housing and a separate metallic element located in the metallic inductor housing.

13. The inductor assembly of claim 1, wherein at least one coil lid covers the end faces of two neighboring inductor windings of two inductor coils arranged side by side, or a separate coil lid is provided for each one of two facing end faces of two adjacent inductor windings of two inductor coils.

14. The inductor assembly of claim 1, wherein at least one coil lid is configured to be attached to the inductor coil from an axial direction of the inductor coil.

* * * * *